US006250484B1

(12) United States Patent
Bartelme

(10) Patent No.: US 6,250,484 B1
(45) Date of Patent: Jun. 26, 2001

(54) COUNTERWEIGHT FOR MONORAIL HOISTS

(75) Inventor: Phillip J. Bartelme, West Allis, WI (US)

(73) Assignee: MHE Technologies, Inc., Wilmington, DE (US)

( * ) Notice: Subject to any disclaimer, the term of this patent is extended or adjusted under 35 U.S.C. 154(b) by 0 days.

(21) Appl. No.: 09/589,458

(22) Filed: Jun. 7, 2000

(51) Int. Cl.[7] ..... B66C 19/00
(52) U.S. Cl. ..... 212/195; 212/178; 212/71
(58) Field of Search ..... 212/195, 196, 212/197, 346, 178, 71, 328; 414/673

(56) References Cited

U.S. PATENT DOCUMENTS

| | | | | |
|---|---|---|---|---|
| 529,751 | | 11/1894 | Reefy . | |
| 3,261,477 | * | 7/1966 | Powell | 212/134 |
| 3,312,434 | | 4/1967 | Simon . | |
| 3,572,803 | * | 3/1971 | Pompe | 294/81 |
| 3,762,755 | * | 10/1973 | Saether | 294/67 AA |
| 3,842,745 | * | 10/1974 | Jones | 104/93 |
| 4,030,747 | * | 6/1977 | Morse et al. | 294/92 |
| 4,260,319 | * | 4/1981 | Motoda et al. | 414/673 |
| 4,449,634 | * | 5/1984 | Buzzichelli et al. | 212/196 |
| 4,525,128 | | 6/1985 | Baker . | |
| 4,537,423 | | 8/1985 | Nau et al. . | |
| 4,569,290 | * | 2/1986 | Hecht et al. | 104/154 |
| 4,705,447 | * | 11/1987 | Smith | 414/673 |
| 4,759,674 | * | 7/1988 | Schroder et al. | 414/146 |
| 4,969,789 | * | 11/1990 | Searle | 212/197 |
| 5,033,705 | | 7/1991 | Reagan . | |
| 5,188,342 | * | 2/1993 | Oellette et al. | 256/65 |
| 5,213,045 | | 5/1993 | Gersemsky . | |

FOREIGN PATENT DOCUMENTS

| | | | | |
|---|---|---|---|---|
| 1307677 | * | 2/1973 | (GB) | 212/346 |
| 10-167674 | * | 6/1998 | (JP) | 212/195 |

* cited by examiner

*Primary Examiner*—Thomas J. Brahan
(74) *Attorney, Agent, or Firm*—Michael Best & Friedrich LLP

(57) ABSTRACT

A counterweight for a monorail hoist. The monorail hoist includes a single support beam and a suspended hoist assembly which is supported for movement along the support beam. The hoist assembly includes a support member which is transverse to the support beam. The counterweight is mounted on the support member. The counterweight is slidable along the support member to optimally balance the overall weight distribution of the hoist assembly. Once the counterweight is properly positioned to balance the hoist assembly, a locking device locks the counterweight to the support member to prevent any further movement of the counterweight along the support member. The locking device is also releasable to allow the counterweight to be moved to or removed from any location along the support member in order to accommodate any changes which may occur to the overall weight distribution of the hoist assembly. Preferably, a plurality of counterweights and cooperating locking devices are provided.

20 Claims, 2 Drawing Sheets

COUNTERWEIGHT FOR MONORAIL HOISTS

BACKGROUND OF THE INVENTION

The invention relates to monorail hoists.

Monorail hoists include a single support beam and a suspended hoist assembly for engaging and moving a load. Because the hoist assembly hangs from the single support beam, it is necessary to balance the overall weight distribution of the hoist assembly in order to prevent the hoist assembly from being cocked. It is known to weld counterweights to a hoist assembly to balance the hoist assembly.

As generally known, a hoist assembly may be imbalanced for a number of reasons such as, for example, a difference in weight between the various components of the hoist assembly, or how the various components of the hoist assembly are assembled. One problem with the noted known manner of balancing a hoist assembly is that welding counterweights to the hoist assembly adds additional expense to the overall manufacturing and assembling costs for the hoist assembly. Another problem with this known manner of balancing a hoist assembly concerns repairs to or replacements of various components of the hoist assembly in the field. It is not uncommon that from time to time various components of a hoist assembly such as, for example, a motor or a gearcase, may need repairing or replacing. As can be appreciated, such a repair or replacement may alter the overall weight distribution of the components making up the hoist assembly. When the overall weight distribution is changed, some of the counterweights already welded to the hoist assembly will have to be removed and/or additional counterweights will have to be added. In any event, the removal of counterweights which have previously been welded to a hoist assembly, or the welding of additional counterweights to the hoist assembly, involves the use of costly equipment and requires time-consuming processes which also results in nonprofitable increased labor costs.

SUMMARY OF THE INVENTION

The present invention provides a counterweight for monorail hoists that alleviates the noted problems and other problems of the prior art. More particularly, the invention provides a counterweight that is slidable along a support member of a hoist assembly so that the counterweight can be properly located along the support member to optimally balance the hoist assembly. Once properly located, the counterweight is held in place along the support member by means other than welding.

In one aspect of the invention, a releasable locking device is used to secure the counterweight to the support member. If the overall weight distribution of the hoist assembly is later changed, in order to balance the modified hoist assembly, the locking device is simply released so that the counterweight can be moved to or removed from any desired location along the support member. If additional counterweights are needed, the additional counterweights are simply mounted on the support member and moved to the appropriate location where they are then secured to the support member by their associated locking devices.

Preferably, the locking device includes a locking bolt which is threaded into a threaded hole in the counterweight to engage a portion of the support member. In order to adjust the location of the counterweight along the support member or remove the counterweight from the support member, the locking bolt is simply unthreaded from the threaded hole to disengage the support member.

The nonwelding locking device and adjustable counterweight of the present invention allow for optimum balancing of a hoist assembly in a more cost effective and efficient manner than previously known.

Other features and advantages of the invention will become apparent to those skilled in the art upon review of the following detailed description, claims and drawings in which like numerals are used to designate like features.

Figure 1:
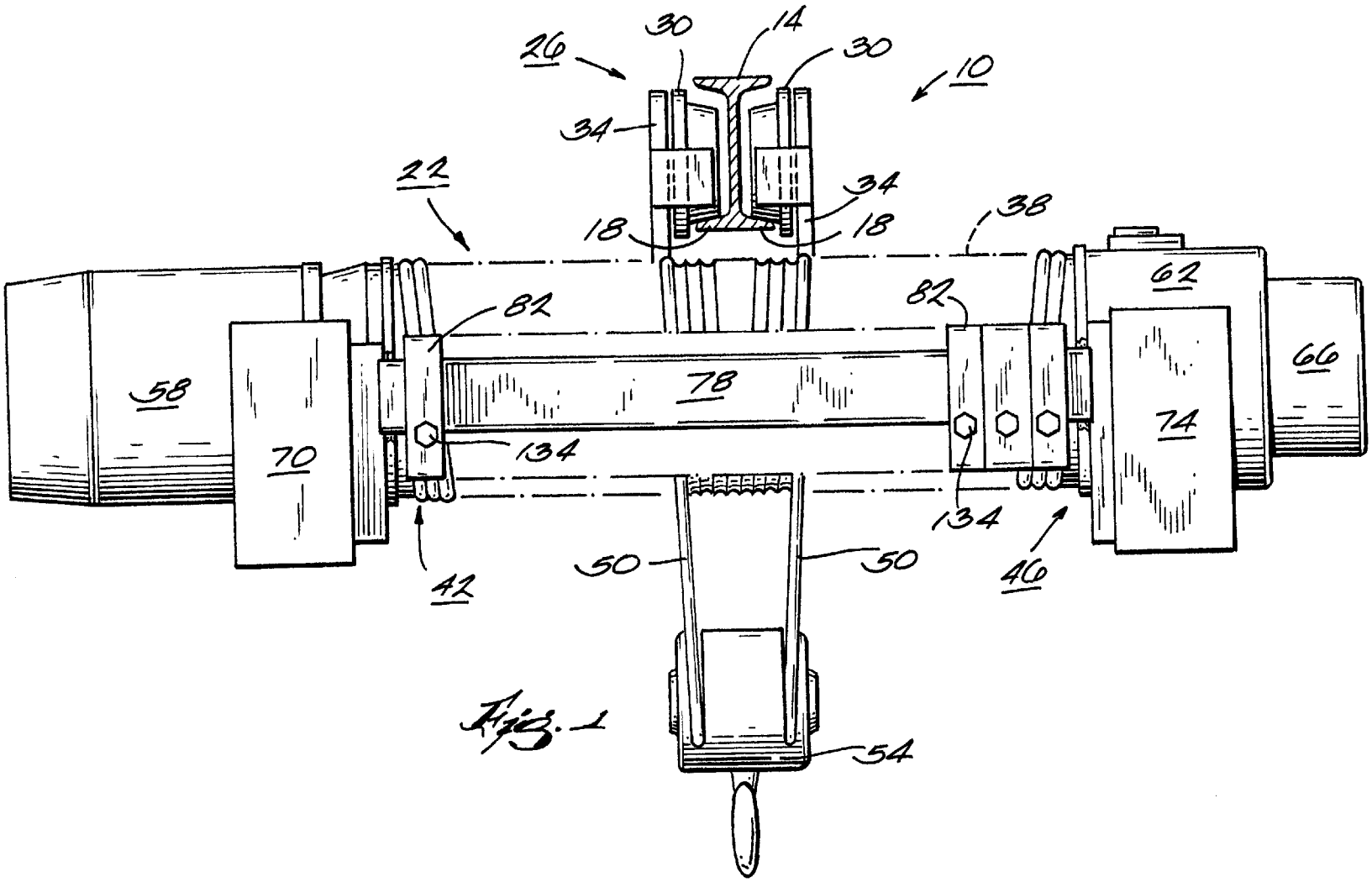
FIG. 1 is a front elevational view of a monorail hoist embodying the invention.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and equivalents thereof.

DETAILED DESCRIPTION OF THE PREFERRED EMBODIMENT

Figures 2, 3:
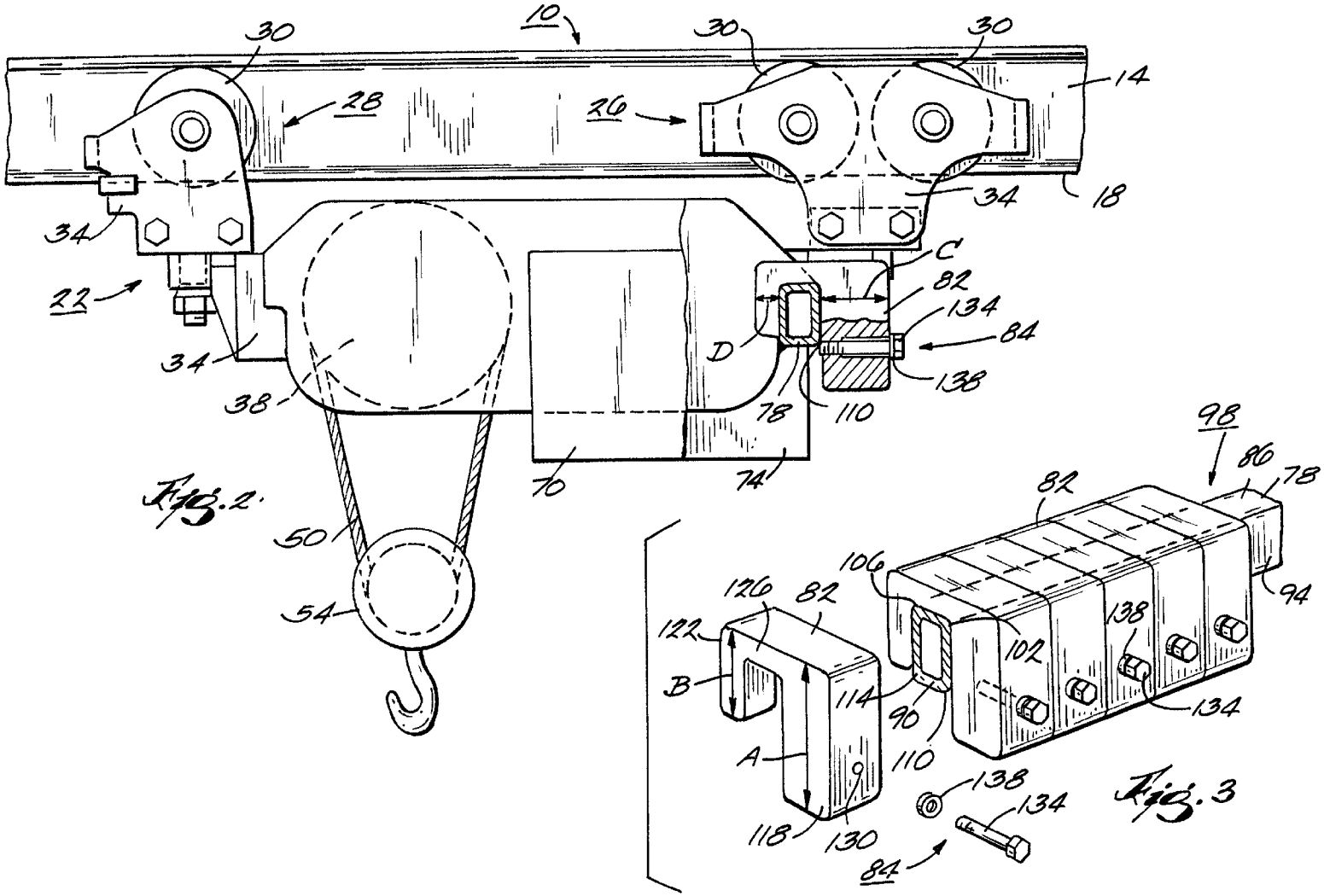
FIG. 2 is a partially cut away side elevational view of the monorail hoist of FIG. 1.
FIG. 3 is an exploded perspective view of a plurality of counterweights mounted on a support member of the hoist.

Illustrated in FIGS. 1 and 2 is a monorail hoist 10 embodying the invention. It should be understood that the present invention is capable of use in other monorail hoists and the monorail hoist 10 is merely shown and described as an example of one such hoist.

The monorail hoist 10 includes a single support beam or rail 14. The beam 14 is a standard I-beam having a bottom flange 18. A hoist assembly 22 is suspended from the beam 14. The hoist assembly 22 includes a pair of suspension trolleys 26 and 28 which include rollers 30 that run along the bottom flange 18 of the beam 14. The hoist assembly 22 also includes a frame 34 which is supported by the trolleys 26 and 28, and which includes a pair of side plates or members 42 and 46 which extend parallel with the beam 14.

The hoist assembly 22 further includes a hoist drum 38 supported by the frame 34. The hoist drum 38 is generally transverse to the beam 14 and extends between the side members 42 and 46. A hoist rope 50 is conventionally wound around the hoist drum 38 and a load engaging device 54 is coupled to the hoist rope 50 for vertical movement in response to rotation of the hoist drum 38. The load engaging device 54 is located directly beneath the beam 14 for maximum load carrying capacity. The load engaging device 54 may be a conventional bottom block as shown.

The hoist assembly 22 also includes a hoist motor 58 for rotating the hoist drum 38. A gearcase 62 is coupled to the hoist motor 58 and to the hoist drum 38. The hoist assembly 22 further includes a brake device 66, preferably an electric brake, for stopping the rotation of the hoist drum 38. The hoist motor 58, the gearcase 62 and the brake device 66 are supported by the frame 34. The hoist assembly 22 also includes control cabinets 70 and 74 which are supported on the frame 34.

The monorail hoist 10 thus far described is well known in the art and further description is therefore not needed.

With continued reference to FIGS. 1 and 2, the frame 34 includes a support member 78 which is perpendicular to the beam 14 and which extends between the side members 42 and 46. A plurality of counterweights 82 are mounted on the support member 78 for balancing the hoist assembly 22. The counterweights 82 are advantageously slidable along the support member 78 so that the hoist assembly 22 can be properly balanced. Once balanced, as will be further explained below, the counterweights 82 are held in place on the support member 78 by locking devices 84.

Referring now to FIG. 3, the support member 78 is preferably a tube having a rectangular cross-section including a top side 86, a bottom side 90, and opposite vertical sides 94 and 98 which extend between the top side 86 and bottom side 90. The support member 78 includes a pair of spaced apart upper corners 102 and 106 which are defined by the top side 86 and sides 94 and 98. The support member 78 also includes a pair of spaced apart bottom corners 110 and 114 which are defined by the bottom side 90 and sides 94 and 98.

With continued reference to FIG. 3 and in conjunction with FIG. 2, each counterweight 82 is substantially "U" shaped, although the counterweights 82 may be of various shapes and sizes consistent with the principles of the present invention. Importantly, the counterweights 82 must cooperate with the support member 78, such that the counterweights 82 can be slidable along the support member 78 and the counterweights 82 can be removably and adjustably attached to the support member 78.

Each counterweight 82 includes a first vertical leg 118, a second vertical leg 122 and a third horizontal leg 126 which extends between the leg 118 and the leg 122. The leg 118 has a vertical dimension A which is greater than a vertical dimension B of the leg 122 (FIG. 3). The leg 118 also has a horizontal dimension C which is greater than a horizontal dimension D of the leg 122 (FIG. 2). The leg 118 includes a threaded hole 130 which extends completely through the leg 118 and which is preferably parallel to the beam 14 (FIG. 2). When a counterweight 82 is mounted on the support member 78, the top side 86 of the support member 78 engages the horizontal leg 126 of the counterweight 82, the vertical side 94 of the support member 78 engages the leg 118 of the counterweight 82, and the vertical side 98 of the support member 78 engages the leg 122 of the counterweight 82. As should be understood, given the configuration of the support member 78 and the mating configuration of each counterweight 82, the counterweights 82 can be slid along the support member 78 until the hoist assembly 22 is properly balanced.

The locking device 84 preferably includes a locking bolt 134. The locking bolt 134 may be a hex-socket screw or any number of various types of bolts or screws in accordance with the principles of the present invention. Once a counterweight 82 is properly positioned along the support member 78, the associated locking bolt 134 is threaded into the associated hole 130 to engage the support member 78, thereby substantially preventing further movement of the associated counterweight 82 along the support member 78. In a preferred embodiment, for maximum holding capability, the locking bolt 134 contacts the bottom corner 110 of the support member 78 (FIG. 2). A lock washer 138 may be used with the locking bolt 134 to prevent the locking bolt 134 from unthreading. Conventional thread locking fluid may be used in place of the lock washer 138. Alternatively, conventional thread locking fluid can be used in combination with the lock washer 138. The locking device 84 may include other fastening means besides the locking bolt 134, which fastening means does not include welding the counterweights 82 to the support member 78.

As shown in FIG. 1, three counterweights 82 are placed near one end of the support member 78 or side member 46 of the frame 34, and one counterweight 82 is placed near the opposite end of the support member 78 or side member 42 of the frame 34, to properly balance the overall weight distribution of the hoist assembly 22. If the motor 58 or any other component of the hoist assembly needs repairing or replacing which would result in a change in the overall weight distribution of the hoist assembly, the counterweights 82 are simply adjusted, removed or added according to the principles of the present invention, thereby properly balancing the modified hoist assembly.

Variations and modifications of the foregoing are within the scope of the present invention. For example, the locking device 84 may include a pin which extends through the counterweight 82 and the support member 78. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A monorail hoist comprising:

a single support beam; and a hoist assembly including a frame suspended from and supported for movement along said beam, said frame including a pair of side members, and said frame further including a support member which is transverse to said beam and which extends between said side members;

a hoist drum supported on said frame, said hoist drum extending between said side members of said frame;

a hoist motor for rotating said drum, said hoist motor being supported on said frame;

a hoist rope wound around said hoist drum;

a device for engaging a load, said device being coupled to said hoist rope for vertical movement in response to rotation of said hoist drum;

a counterweight mounted on said support member for balancing said hoist assembly, said counterweight being slidable along said support member while said hoist drum is suspended from said beam; and a locking device for holding said counterweight in place in any desired location along said support member.

2. A monorail hoist according to claim 1, wherein said locking device is releasable to allow said counterweight to be moved along said support member.

3. A monorail hoist according to claim 1, wherein said counterweight includes a threaded hole, and wherein said locking device includes a locking bolt which is threaded into said threaded hole to engage said support member.

4. A monorail hoist according to claim 3, wherein said locking device further includes a locking washer to prevent said locking bolt from unthreading.

5. A monorail hoist according to claim 3, wherein said locking device further includes a thread locking fluid to prevent said locking bolt from unthreading.

6. A monorail hoist according to claim 1, wherein said counterweight is substantially "U" shaped, such that said counterweight is mounted on said support member to open downwardly and away from said beam.

7. A monorail hoist according to claim 6, wherein said counterweight includes a first vertical leg, a second vertical leg and a horizontal leg extending between said first vertical leg and said second vertical leg, said first vertical leg being longer than said second vertical leg, and said first vertical leg having therethrough a threaded hole, and wherein said locking device includes a locking bolt which is threaded into said said threaded hole to engage said support member.

8. A monorail hoist according to claim 7, wherein said support member has a substantially rectangular cross-section and includes a lower corner, and wherein said locking bolt engages said lower corner.

9. A monorail hoist according to claim 6, further comprising:

one or more additional substantially a "U" shaped counterweights mountable on the support member to open downwardly and away from the beam, said counterweights being slidable along the support member to optimally balance the hoist assembly; and one or more additional locking devices, one for each additional counterweight, for holding said counterweights in place in any desired location along the support member.

10. A monorail hoist according to claim 1, wherein each additional locking device is releasable to allow said counterweights to be moved along the support member.

11. A monorail hoist according to claim 1, further comprising:

one or more additional counterweights mounted on said support member for balancing said hoist assembly, said counterweights being slidable along said support member; and one or more additional locking devices, one for each additional counterweight, for holding said counterweights in place in any desired location along said support member.

12. A monorail hoist according to claim 11, wherein each additional locking device is releasable to allow said counterweights to be moved along said support member.

13. A monorail hoist according to claim 1, wherein said hoist drum includes an axis of rotation which is perpendicular to said beam, and wherein said support member is fixed relative to said axis.

14. A monorail hoist according to claim 13, wherein said counterweight is movable along said support member relative to said side members.

15. A monorail hoist according to claim 14, wherein said side members are parallel with said beam, and wherein said support member is perpendicular to said beam.

16. A monorail hoist according to claim 1, wherein said device for engaging a load is located directly below said beam.

17. A monorail hoist comprising:

a single support beam; and a hoist assembly including a pair of suspension trolleys, each trolley including a plurality of rollers movable along said beam;

a frame supported by said suspension trolleys, said frame including a support member which is transverse to said beam, said support member having a substantially rectangular cross-section and includes a lower corner;

a hoist drum supported on said frame;

a hoist motor for rotating said hoist drum, said hoist motor being supported on said frame;

a hoist rope wound around said hoist drum;

a device for engaging a load, said device being coupled to said hoist rope for vertical movement in response to rotation of said hoist drum;

a plurality of substantially "U" shaped counterweights mounted on said support member for balancing said hoist assembly, each of said counterweights including a first vertical leg, a second vertical leg and a horizontal leg extending between said first vertical leg and said second vertical leg, said first vertical leg including a threaded hole which extends completely through said first vertical leg, each of said counterweights being slidable along said support member to optimally balance said hoist assembly; and a plurality of locking bolts, one for each counterweight, each of said locking bolts being threaded into the associated threaded hole of the associated counterweight to engage said bottom corner of said support member to hold the associated counterweight in place in any desired location along said support member, and each of said locking bolts being unthreadable from the associated threaded hole to allow the associated counterweight to be moved along said support member.

18. A monorail hoist comprising:

a single support beam; and a hoist assembly including a frame supported for movement along said beam, said frame including a support member which is transverse to said beam;

a hoist drum supported on said frame;

a hoist motor for rotating said drum, said hoist motor being supported on said frame;

a hoist rope wound around said hoist drum;

a device for engaging a load, said device being coupled to said hoist rope for vertical movement in response to rotation of said hoist drum;

at least two counterweights mounted on said support member for balancing said hoist assembly, said counterweights being slidable along said support member; and at least two locking devices, one for each counterweight, for holding said counterweights in place in any desired location along said support member.

19. A monorail hoist according to claim 18, wherein each locking device is releasable to allow said counterweights to be moved along said support member.

20. A monorail hoist according to claim 18, wherein said frame includes a pair of side members and is suspended from said beam, such that said support member and said hoist drum extend between said side members, and wherein said counterweights are slidable along said support member while said hoist drum is suspended from said beam.

* * * * *